US007925184B2

(12) United States Patent
Yamada

(10) Patent No.: US 7,925,184 B2
(45) Date of Patent: Apr. 12, 2011

(54) DEVELOPER SUPPLY CONTAINER MOUNTABLE TO A HOLLOW PORTION OF A ROTATBLE PHOTOSENSITIVE MEMBER AND DEVELOPER SUPPLYING SYSTEM HAVING SUCH

(75) Inventor: Yusuke Yamada, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 505 days.

(21) Appl. No.: 12/066,150

(22) PCT Filed: Dec. 21, 2006

(86) PCT No.: PCT/JP2006/326165
§ 371 (c)(1),
(2), (4) Date: Mar. 7, 2008

(87) PCT Pub. No.: WO2007/072991
PCT Pub. Date: Jun. 28, 2007

(65) Prior Publication Data

US 2009/0154956 A1 Jun. 18, 2009

(30) Foreign Application Priority Data

Dec. 21, 2005 (JP) ..... 2005-368141

(51) Int. Cl.
*G03G 15/08* (2006.01)

(52) U.S. Cl. ..... 399/120; 399/258; 399/261

(58) Field of Classification Search ..... 399/120, 399/258, 261
See application file for complete search history.

(56) References Cited

U.S. PATENT DOCUMENTS

| | | | | |
|---|---|---|---|---|
| 5,742,882 | A | 4/1998 | Lee | 399/258 |
| 6,314,261 | B1 | 11/2001 | Omata et al. | |
| 6,879,789 | B2 | 4/2005 | Yamada et al. | |
| 6,920,298 | B2 | 7/2005 | Yamada et al. | |
| 6,934,494 | B2 | 8/2005 | Yamada et al. | |
| 6,944,417 | B2 | 9/2005 | Yamada et al. | |
| 6,947,690 | B2 | 9/2005 | Tazawa et al. | |
| 6,963,713 | B2 | 11/2005 | Isomura et al. | |
| 6,980,754 | B2 | 12/2005 | Isomura et al. | |
| 6,990,301 | B2 | 1/2006 | Yamada et al. | |

(Continued)

FOREIGN PATENT DOCUMENTS

JP 56-146171 A 11/1981

(Continued)

OTHER PUBLICATIONS

Machine Translation of JP-08-076573.*

(Continued)

*Primary Examiner* — David M Gray
*Assistant Examiner* — G. M. Hyder
(74) *Attorney, Agent, or Firm* — Fitzpatrick, Cella, Harper & Scinto

(57) ABSTRACT

A developer supply container (1) detachably mountable to a hollow portion of a rotatable photosensitive member (100) provided in a electrophotographic image forming apparatus, the container including a rotatable container body having an inner space for containing a developer; a feeding portion (5) for feeding the developer in the container body with a rotation of the container body to discharge the developer out of the container body; and a engageable portion (3*a*) which is engageable with the photosensitive member so that container body is rotated integrally with the photosensitive member by a rotational driving force received from a driving member (104) provided in the electrophotographic image forming apparatus.

11 Claims, 9 Drawing Sheets

U.S. PATENT DOCUMENTS

| | | | | |
|---|---|---|---|---|
| 6,993,273 | B2 | 1/2006 | Yamada | |
| 7,039,347 | B2 | 5/2006 | Yamada et al. | |
| 7,079,788 | B2 | 7/2006 | Ban et al. | |
| 7,127,193 | B2 | 10/2006 | Yamada et al. | |
| 7,155,138 | B2 | 12/2006 | Yamada | |
| 7,190,925 | B2 | 3/2007 | Isomura et al. | |
| 7,209,686 | B2 | 4/2007 | Yamada | |
| 7,324,777 | B2 | 1/2008 | Yamada et al. | |
| 2002/0150410 | A1 | 10/2002 | Matsuda et al. | 399/263 |
| 2005/0047818 | A1 | 3/2005 | Yamada et al. | |
| 2006/0008290 | A1 | 1/2006 | Yamada et al. | |
| 2006/0008291 | A1 | 1/2006 | Yamada et al. | |
| 2006/0133855 | A1 | 6/2006 | Yamada | |
| 2007/0092304 | A1 | 4/2007 | Yamada et al. | |
| 2007/0098454 | A1 | 5/2007 | Yamada et al. | |
| 2007/0134021 | A1 | 6/2007 | Yamada et al. | |

FOREIGN PATENT DOCUMENTS

| | | | |
|---|---|---|---|
| JP | 4-191770 | A | 7/1992 |
| JP | 8-76573 | A | 3/1996 |
| JP | 2918677 | B2 | 4/1999 |
| JP | 2002-351174 | A | 12/2002 |

OTHER PUBLICATIONS

Machine translaion of JP-2002-351174.*
Machine translation of JP-2918677.*

* cited by examiner (a)

(b)

DEVELOPER SUPPLY CONTAINER MOUNTABLE TO A HOLLOW PORTION OF A ROTATBLE PHOTOSENSITIVE MEMBER AND DEVELOPER SUPPLYING SYSTEM HAVING SUCH

TECHNICAL FIELD

The present invention relates to a developer supply container which is removably mountable in a hollow portion of a photosensitive member disposed in an image forming apparatus, and a developer supplying system which employs such a developer supply container. As examples of an electrophotographic image forming apparatus, a copying machine, a printer, a facsimile machine, etc., which employ an electrophotographic image forming method, can be listed.

BACKGROUND ART

Toner has long been used as the developer for an electrophotographic image forming apparatus, such as a copying machine, a printer, etc. As the toner in an image forming apparatus is consumed for image formation, the image forming apparatus is supplied with the toner from a toner container (which sometimes is referred to as toner cartridge). Since toner is made up of microscopic particles, various methods have been proposed for preventing toner from scattering while supplying an image forming apparatus with toner, and some of these methods have been put to practical use. According to one of these methods, a toner container is kept in an image forming apparatus, and the toner in the toner container is discharged little by little from the toner container.

The black-and-white image forming apparatuses stated in Japanese Laid-open Patent Application 4-191770, 2002-351174, etc., are structured so that a toner container is mounted in the hollow portion of a photosensitive drum, in order to utilize the hollow portion of the photosensitive drum as the bay for a toner container to reduce the apparatus in size.

However, these image forming apparatuses are structured so that a toner container rotates with a photosensitive drum which is rotationally driven by the main assembly of an image forming apparatus. Therefore, it is possible that an image forming operation will be started even though there is no toner container in the apparatus, that is, even though the main assembly of the image forming apparatus is in the state in which toner cannot supplied to the main assembly. In other words, it is possible that the photosensitive drum begins to be rotationally driven even though the apparatus main assembly is in the state in which toner cannot be supplied to the apparatus main assembly. Further, in order to discharge the toner from a toner container, the toner container must be provided with some kind of mechanism for conveying toner in the toner container by receiving rotational driving force transmitted from the photosensitive drum.

In recent years, colorization has been rapidly gaining momentum in the field of an image forming apparatus, such as a copying machine, a printer, etc. Therefore, a color image forming apparatus employing multiple photosensitive members has begun to attract attention. Obviously, a color copying machine, a color printer, etc., use at least four developers different in color, for example, black (Bk), yellow (Y), cyan (C), and magenta (M) developers. Therefore, a space large enough for four toner containers is necessary in the main assembly of a color image forming apparatus. Thus, a color image forming apparatus is likely to be larger than a black-and-white image forming apparatus. In other words, the space required for the multiple toner containers is one of the primary obstacles that prevent an electrophotographic color image forming apparatus from being substantially reduced in size.

DISCLOSURE OF THE INVENTION

The primary object of the present invention is to provide a developer supply container and a developer supplying system, which can solve the above-described problem.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, the developer supply containers, and the developer supplying systems, which are in the preferred embodiments of the present invention, will be described with reference to the appended drawings. Incidentally, the structural arrangements in the following preferred embodiments of the present invention, which will be described below, are not intended to limit in scope the present invention. That is, the present invention includes various modifications of these structural arrangements, which fall within the scope of the present invention.

Embodiment 1

First, referring to FIG. 1, the electrophotographic image forming apparatus in this embodiment will be described regarding its structure. This image forming apparatus is an example of a multicolor image forming apparatus in which a toner supply container as a developer supply container is mounted. Here, an electrophotographic image forming apparatus means an apparatus which forms an image on recording medium with the use of an electrophotographic image forming method. It includes an electrophotographic copying machine, an electrophotographic printer (for example, laser beam printer, LED printer, etc.), a facsimile apparatus, a wordprocessor, and the like.

(Image Forming Apparatus)

Figure 1:
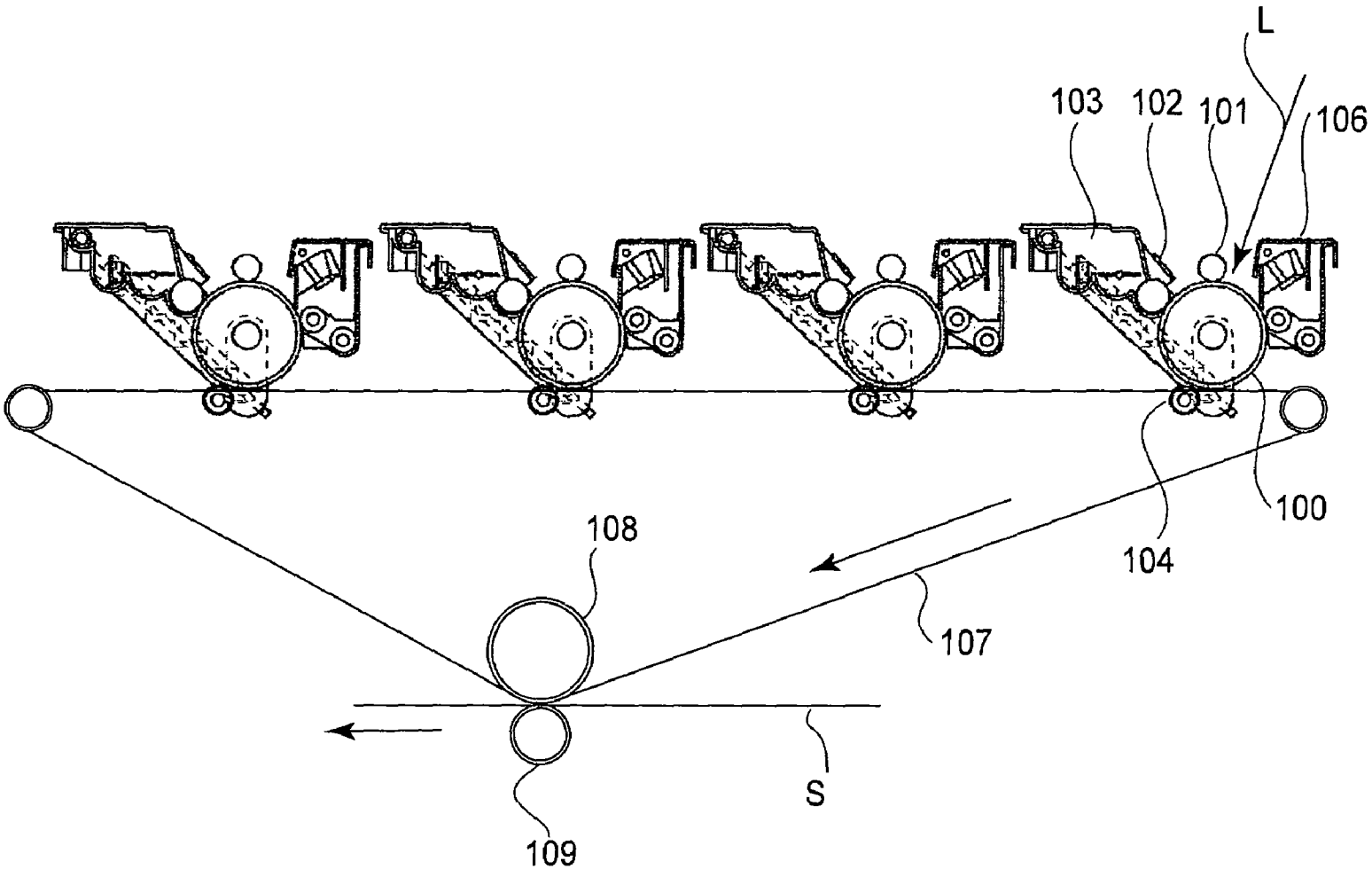
FIG. 1 is a cross-sectional view of the essential portions of the image forming apparatus in one of the preferred embodiments of the present invention.

FIG. 1 is a sectional view of the image forming portion of the main assembly of the image forming apparatus (hereafter, main assembly of image forming apparatus may be referred to simply as apparatus main assembly), showing the general structure thereof. Shown here is the image forming portion which belongs to the above-mentioned color copying machine as an example of a multicolor image forming apparatus having multiple image forming stations which uses black (Bk), magenta (M), cyan (C), and yellow (Y) toners as developer. The image forming stations are juxtaposed in parallel. Incidentally, the machine may be structured so that it uses special purpose toners, such as red toner or transparent toner, in addition to the above-mentioned toners. Further, it may be structured so that it uses darker and lighter magenta toners, and darker and lighter cyan toners, in addition to the above-mentioned ordinary magenta and cyan toners. In such cases, all that is necessary is to provide the apparatus with additional image forming stations, which will be described later.

First, the image forming stations will be described in detail. However, all the image forming stations are the same in structure, although they are different in the toner they use. Therefore, only one of the image forming stations will be described.

Each image forming station is provided with a photosensitive member 100 (which hereafter will be referred to as photosensitive drum) as an image bearing member (electrophotographic photosensitive member). The photosensitive drum 100 is rotationally driven. It is disposed in contact with an intermediary transfer belt 107.

The photosensitive drum 100 is rotatably supported by its peripheral surface at its lengthwise end portions by unshown roller bearings. That is, the photosensitive drum 100 is kept in a preset position in the apparatus main assembly. Therefore, the photosensitive drum 100 is rotatable about a preset rotational axis without wobbling.

In the adjacencies of the peripheral surface of the photosensitive drum 100, a charge roller 101 is disposed so that it is rotated by the rotation of the photosensitive drum 100. The image forming station is structured so that charge bias is applied to the charge roller 101 from an electric power source with preset timing. In this embodiment, the combination of AC and DC voltage is applied as the charge bias (oscillatory voltage) to the charge roller 101 to uniformly charge the peripheral surface of the photosensitive drum 100. As the charge bias is applied to the charge roller 101, electrical discharge occurs in the microscopic gaps between the peripheral surfaces of the charge roller 101 and photosensitive drum 100. As a result, the peripheral surface of the photosensitive drum 100 is charged.

Onto the uniformly charged area of the peripheral surface of the photosensitive drum 100, a beam of laser light L is projected from the exposing apparatus of the image forming apparatus while being modulated with picture information. As a result, an electrostatic image is formed on the photosensitive drum 100. More specifically, the exposed points of the uniformly charged area of the peripheral surface of the photosensitive drum 100 reduces in potential, whereas the unexposed points of the uniformly charged area of the peripheral surface of the photosensitive drum 100 do not reduce in potential. Therefore, an electrophotographic latent image which reflects the picture information is effected.

The electrostatic latent image effected on the photosensitive drum 100 is moved to a developing device 103 as a developing means by the rotation of the photosensitive drum 100. As the electrostatic latent image reaches the developing device 103, it is developed into a visible image by the toner, as developer, supplied to the latent image from the peripheral surface of a development roller 102, which is coated with the toner, and to which development bias, that is, the combination of AC and DC voltages are applied from the electric power source. Incidentally, in this embodiment, the reversal development method is employed, which adheres toner to the points of the charged area of the peripheral surface of the photosensitive drum 100, which have been exposed by the beam of laser light. Further, the image forming apparatus is structured so that toner is supplied to the developing means from the toner supply container 1 by the amount proportional to the amount of the toner consumed through the development process. The toner supply container 1 will be described later.

The toner image on the photosensitive drum 100 is transferred (primary transfer) onto an intermediary transfer belt 107 by a primary transfer roller 104. During this process, primary transfer bias (DC) is applied to the primary transfer roller 104 from an electric power source.

The above-described processes are repeated in each image forming station. As a result, black (Bk), magenta (M), cyan (C), and yellow (Y) toner images are sequentially transferred in layers onto the intermediary transfer belt 107.

Meanwhile, a recording medium S is conveyed from a sheet feeder cassette, in which it has been stored, toward the intermediary transfer belt 107 by an unshown sheet conveyance mechanism so that it will arrive at the intermediary transfer belt 107 in synchronization with the arrival of the toner images at the intermediary transfer belt 107.

The toner images on the intermediary transfer belt 107, which has effected a color image, are transferred (secondary transfer) all at once onto the recording medium S, in the secondary transfer area formed by a roller 109 (which opposes secondary transfer) and intermediary transfer belt 107. During this process, secondary transfer bias (DC) voltage is applied to a secondary transfer roller 108 from an electric power source.

The color image formed on the recording medium S is conveyed to a fixing apparatus, in which it is fixed to the recording medium S by the heat and pressure applied thereto by the fixing apparatus. As a result, the color image on the recording medium S becomes a permanent image. After the fixation, the recording medium S is discharged from the apparatus, ending the image formation sequence.

Incidentally, the toner remaining on the peripheral surface of the photosensitive drum 100 after the primary transfer is removed from the photosensitive drum 100 by a cleaner 106, and is recovered into a waste toner storage portion.

(Toner Supply Container)

Figure 2:
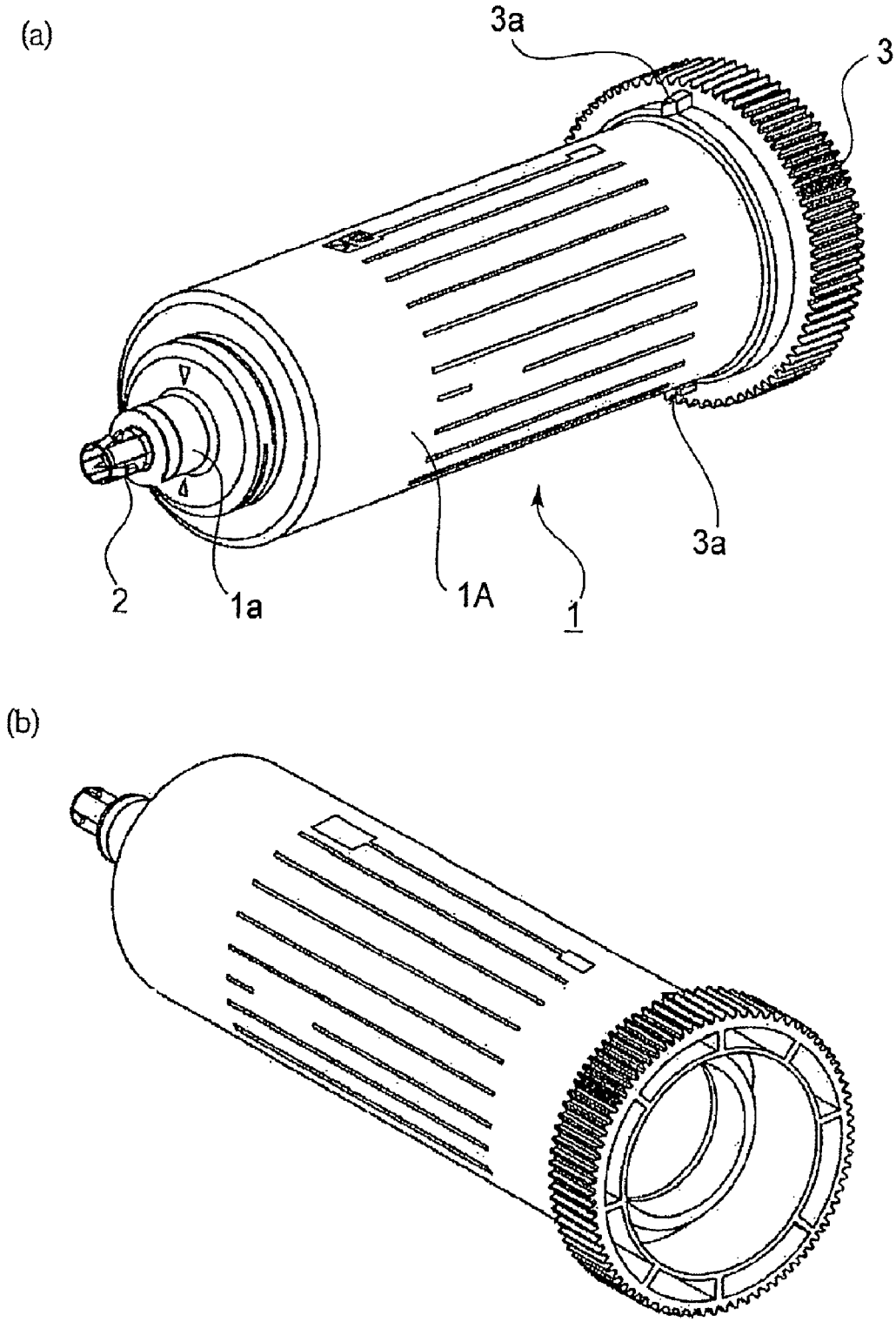
FIG. 2 is an external perspective view of the toner discharging portion of the toner supply container, as seen from (a) the front side, and (b) the back side.

Next, referring to FIG. 2, the toner supply container 1 as a developer supply container will be described.

The toner supply container 1 has a container proper 1A in which toner is stored. The container proper 1A is roughly in the form of a cylinder. The toner supply container 1 also has a toner outlet 1*a* as a developer outlet (developer discharge port), which is smaller in diameter than the container proper 1A. The toner outlet 1*a* protrudes from one of the lengthwise ends of the container proper 1A in the lengthwise direction of the container proper 1A.

The toner outlet 1*a* is provided with an opening as a developer discharge opening, which is at the end of the toner outlet 1*a*. Normally, this opening is kept sealed by a sealing member 2. The end portion of the sealing member 2 is provided with a snap-lock portion, which is provided with a pair of protrusions 2*a*, which snap into the pair of holes with which the coupler 20 is provided. The coupler 20 will be described later. The snap-lock portion is also provided with a pair of protrusions 2*b*, which are for disengaging the protrusions 2*a* from the coupler 20. Each protrusion 2*b* is structured so that as a decoupler ring 21 (which will be described later) is slid, it receives the force applied by a decoupler ring 21 to displace the snap-lock portion toward the axial line of the sealing member 2. While the snap-lock portion is in the position into which it is displaced by the decoupler ring 21, the snap-lock portion and coupler 20 can be disengaged from each other, without being damaged, by retracting the toner supply container 1.

Further, the other lengthwise end of the container proper 1A is provided with a gear portion 3 as a driving force receiving portion, which engages with a driving gear 104 as a driving member, which is on the main assembly side. Incidentally, the driving force receiving portion does not need to be in the form of a gear. That is, it may be in the form of one of the known couplers. When the driving force receiving portion is in the form of a coupler, the driving member must be in the form of a coupler which matches the coupler on the toner supply container side.

The toner supply container 1 is also provided with an engaging portion 3*a* as an engageable portion which engages with the photosensitive drum 100 when the toner supply container 1 is mounted into the hollow of the photosensitive drum 100. The engaging portion 3*a* is on the peripheral surface of the toner supply container 1, being in the adjacencies of the gear portion 3. The apparatus is structured so that the engaging portion 3*a*, which is in the form of a protrusion, fits into a groove 100*a* of the internal surface of the photosensitive drum 100, to make the photosensitive drum 100 rotates with the toner supply container 1. That is, a part of the toner supply container 1 is engaged with a part of the photosensitive drum 100. Further, the engaging portion 3*a* is given the role of a driving force transmitting portion, in addition to the role of the engagement portion. That is, the rotational driving force which the gear portion 3 receives from the driving gear 104 on the apparatus main assembly side is transmitted to the photosensitive drum 100 through the interface between the engaging portion 3*a* and the walls of the groove 100*a* in the internal surface of the photosensitive drum 100.

Incidentally, in this embodiment, the toner supply container 1 is provided with two engagement portions 3*a*, which are positioned so that they oppose each other across the toner supply container 1 in terms of the diameter direction of the toner supply container 1 and the photosensitive drum 100 is respectively provided with the grooves 100*a*. However, the number and positioning of the portions 3*a* do not need to be limited to those in this embodiment. That is, they are optional; for example, the number of the engagement portions 3*a* may be only one.

Further, the structural arrangement for making the toner supply container 1 rotate with the photosensitive drum 100 does not need to be limited to the above-described one. For example, the engaging portion 3*a* and groove 100*a* may be reversed in the component to which they are made to belong. Moreover, the structure may be as will be described next.

That is, the toner supply container 1 is shaped so that the rear end portion, in terms of the toner supply container insertion direction, is greater in diameter than the rest of the toner supply container 1 (thus, the rear end portion may be referred to as a large diameter portion (engageable portion)). More specifically, the rear end portion is rendered slightly larger in diameter than the rest of the toner supply container 1 so that as the toner supply container 1 is inserted into the hollow portion of the photosensitive drum 100, contact pressure is generated between the peripheral surface of the large diameter portion of the toner supply container 1 and the internal surface of the photosensitive drum 100 by such an amount that is large enough to cause the photosensitive drum 100 to rotate with the toner supply container 1, while being small enough to allow the toner supply container 1 to be easily removed from the photosensitive drum 100. In the case of such a structural arrangement, the operation to be carried out by an operator to align the above-mentioned engaging portion 3*a*, which is in the form of a protrusion, with the groove 100*a* is not required when mounting the toner supply container 1 into the photosensitive drum 100. Therefore, the structural arrangement can improve the apparatus in operational efficiency.

As described above, one of the lengthwise ends of the toner supply container 1 is provided with the engaging portion 3*a*. Therefore, the following effects can also be obtained. That is, as the toner supplying operation continues, the toner in the toner supply container 1 shifts toward the toner outlet 1*a* located at the opposite lengthwise end (downstream end in terms of developer conveyance direction) from where the engaging portion 3*a* is located. As the toner shifts toward the toner outlet 1*a*, it is possible that the opposite lengthwise end (upstream end in terms of developer conveyance direction) of the toner supply container 1 from where the toner outlet 1*a* is located, will wobble. The structural arrangement in this embodiment prevents this problem of wobbling.

Figure 3:
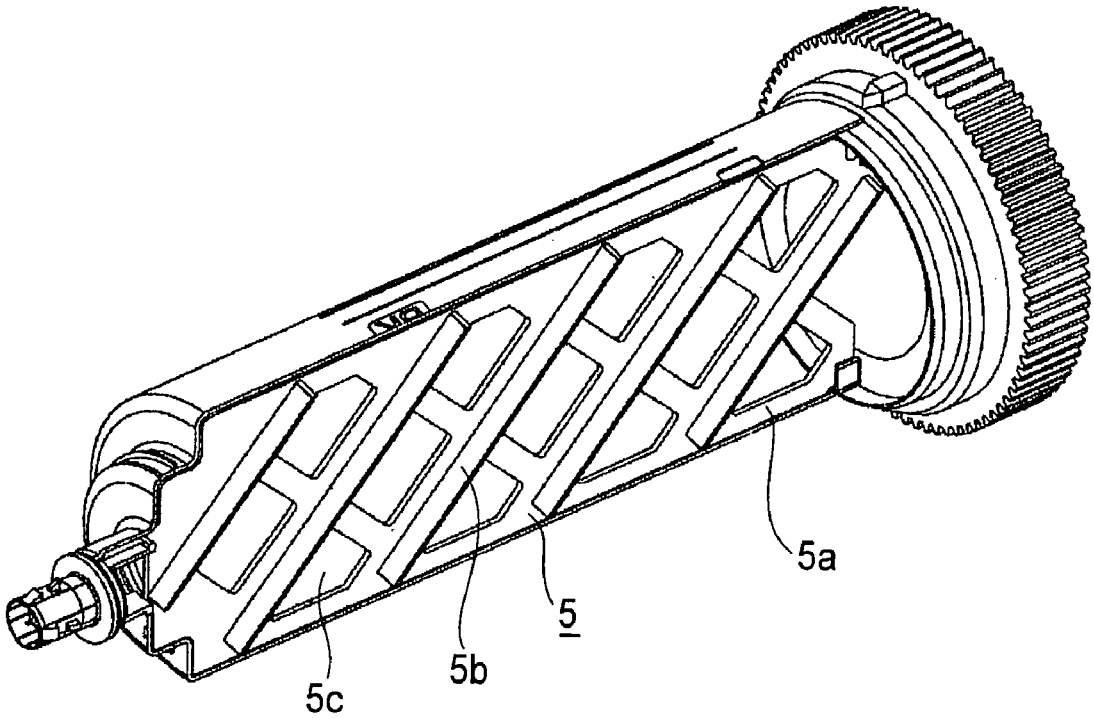
FIG. 3 is a perspective (partially cutaway) view of the toner supply container, showing the toner baffling member.

Referring to FIG. 3, the toner supply container 1 is provided with a toner baffling member 5 as a toner conveying member, which is disposed in the toner supply container 1 to convey the toner in the toner supply container 1 toward the toner outlet 1*a* as the toner supply container 1 is rotated. The baffling member extends across virtually the entire length of container proper 1A. It is provided with a partition (support) plate 5*a* solidly fixed to the container proper 1*a*. To the partition plate 5*a*, multiple toner conveyance guides 5*b* are attached as developer guiding portions, which are in the form of a rib and protrude from the partition plate 5*a*. The toner conveyance guides 5*b* are tilted relative to the rotational axis of the toner supply container 1. The partition plate 5*a* is provided with multiple through holes 5*c* for stirring the toner by allowing the toner to fall from one side of the partition plate 5*a* to the other in terms of the diameter direction of the toner supply container 1.

More specifically, as the toner supply container 1 is rotated, the toner in the toner supply container 1 is lifted by the partition plate 5*a*, and slides on the partition plates 5*a* and toner conveyance guides 5*b*, being thereby conveyed toward the toner outlet 1*a*. As the body of the lifted toner slides toward the toner outlet 1*a*, a part of the body of the lifted toner falls through the through holes 5*c* into the bottom side of the container proper 1A, being thereby stirred and mixed.

Incidentally, the above-described toner conveying portion does not need to be in the above-described form. That is, as long as the toner conveying portion can conveyed the toner when the toner supply container 1 is rotated, its structure does not matter. For example, it may be a spiral rib formed on the internal surface of the toner supply container 1.

(Toner Supplying Operation of Toner Supply Container)

Next, referring to FIGS. 4-7, and 11, the toner supplying operation of the toner supply container 1 will be described.

Figure 4:
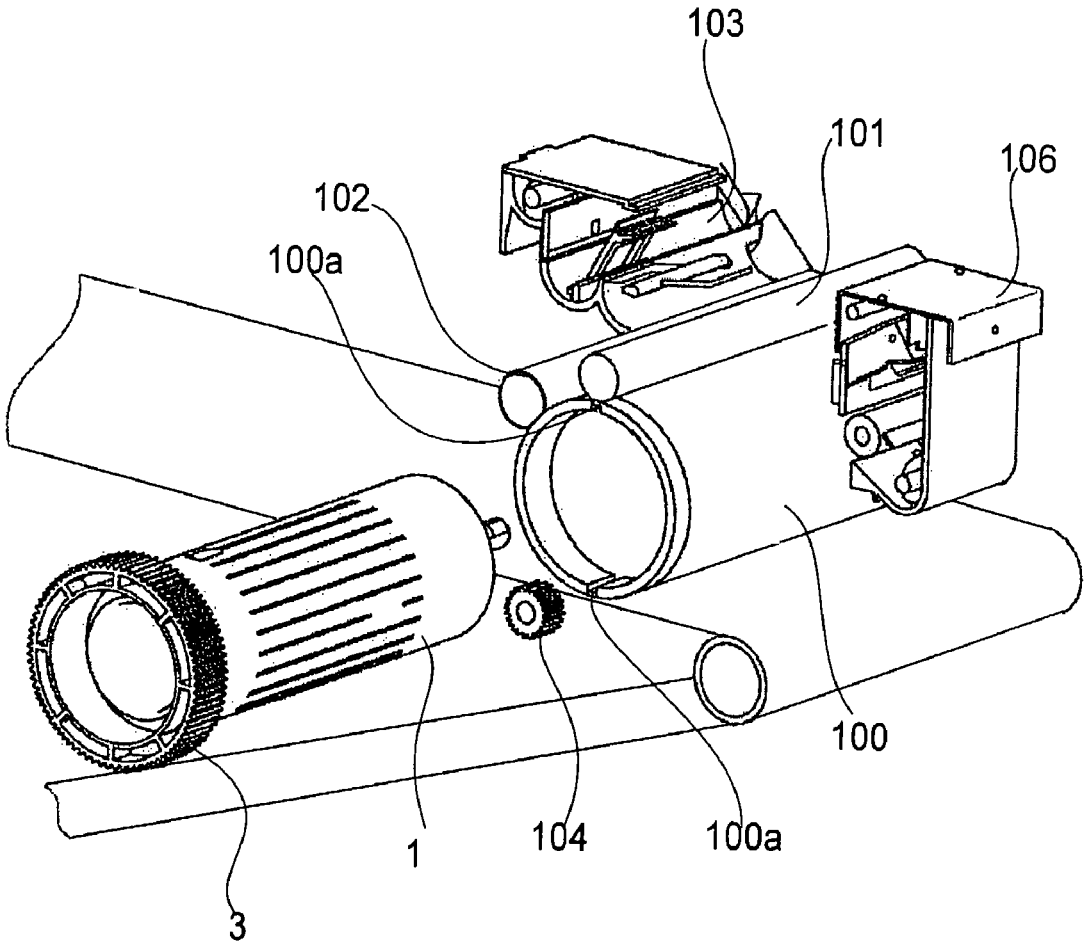
FIG. 4 is a perspective (partially cross-sectional) view of the toner supply container, photosensitive drum, and their adjacencies, showing how the toner supply container is mounted.
Figure 5:
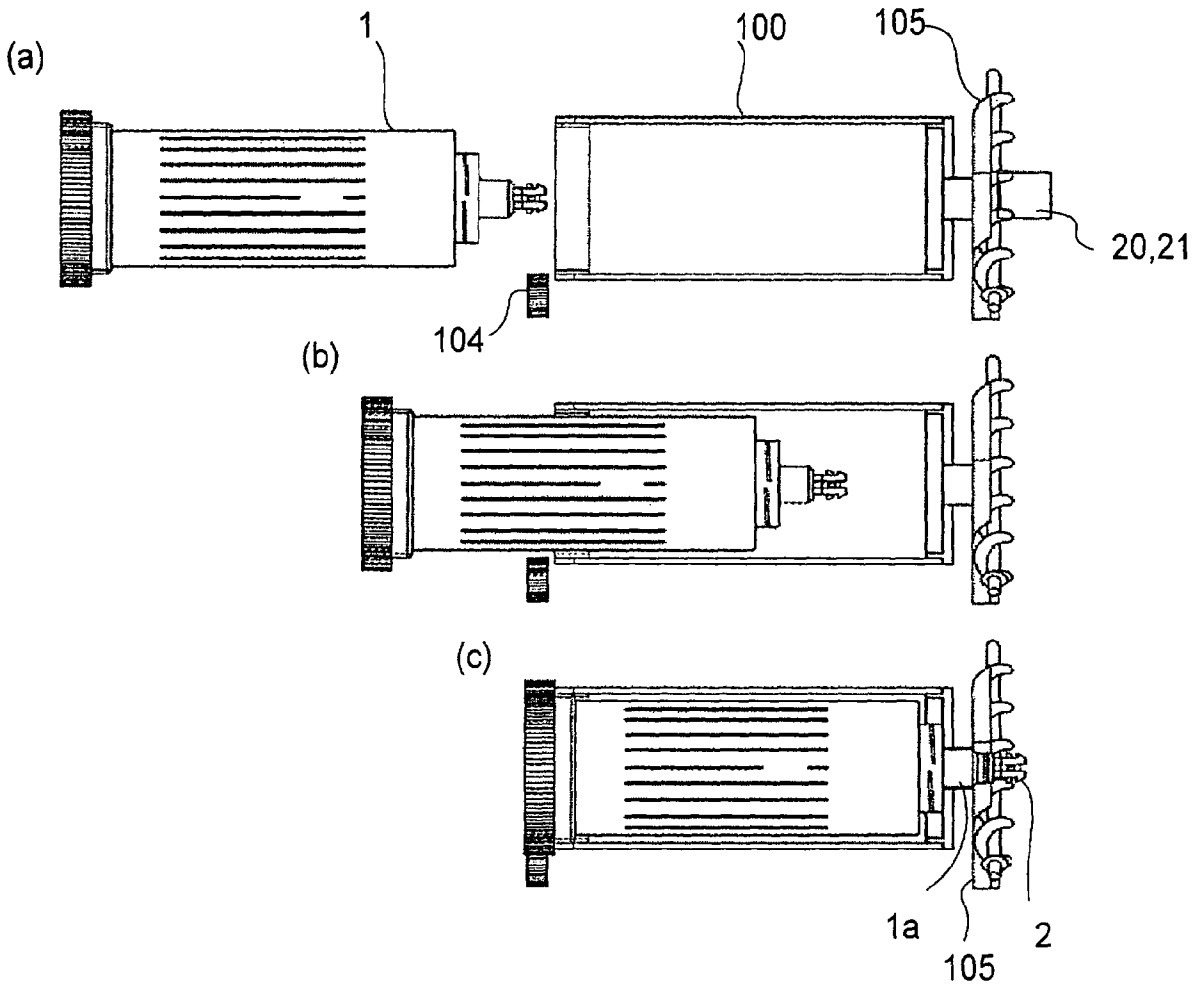
FIG. 5 is a schematic drawing of the toner supply container, photosensitive drum, and their adjacencies, (a) before, (b) during, and (c) after the toner supply container is mounted.
Figure 6:
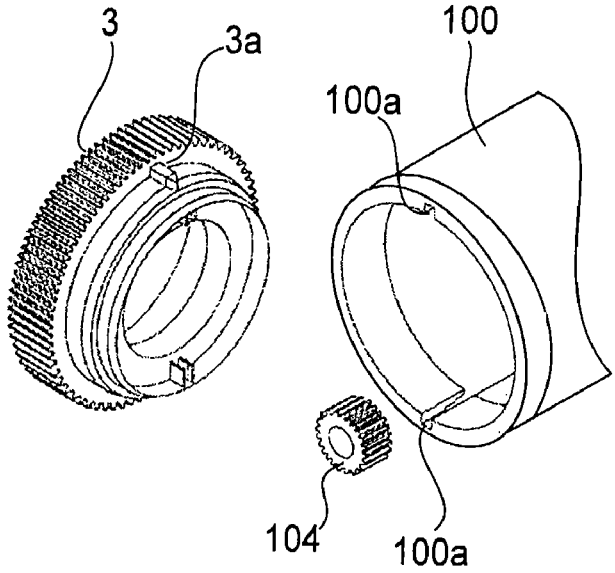
FIG. 6 is a perspective view of the gear portion of the toner supply container, the lengthwise end of the photosensitive drum, which engages with the toner supply container, and the driving gear on the apparatus main assembly side, showing how they engage.
Figure 11:
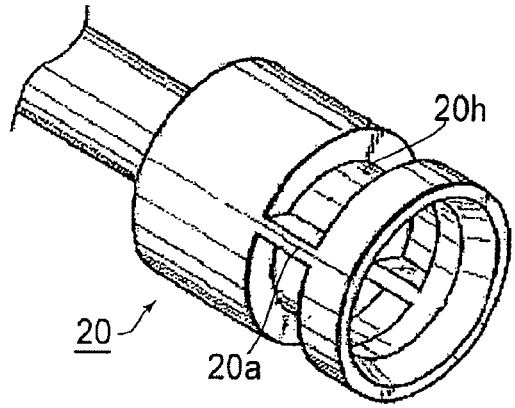
FIG. 11 is a schematic perspective view (a) of the coupling member (coupler), and a schematic perspective view (b) of the toner outlet portion of the toner supply container, which is open.
Figure 11:
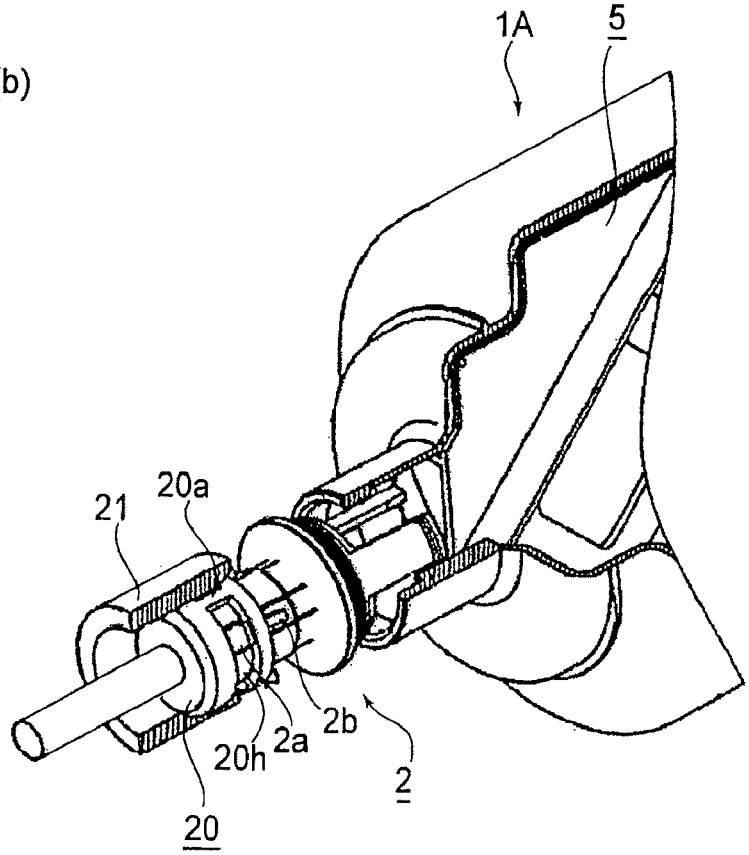

FIG. 4 is a partially cutaway perspective view of the image forming apparatus and toner supply container 1, and FIG. 5 is a schematic drawing of the photosensitive drum 100 and toner supply container 1, showing the distinctive positional relationships between the toner supply container 1 and photosensitive drum 100 in the operation for inserting the toner supply container 1 into the photosensitive drum 100. FIG. 11(*a*) is a perspective view of the hollow cylindrical coupler 20, as the means for unsealing or resealing the toner supply container 1 (toner outlet 1*a*), with which the apparatus main assembly is provided. The coupler 20 is structured so that it can be engaged with the above-described sealing member 2. The coupler 20 is provided with a pair of holes 20*h*, into which the pair of protrusions 2*a* of the snap-lock portion fit, and a pair of ribs 20*a* which separate the pair of holes 20*h* in terms of the circumferential direction of the coupler 20.

Referring to FIG. 4, designated by a referential numeral 100 is a photosensitive drum, which is hollow, providing thereby a space (toner supply container bay) into which the toner supply container 1 can be inserted. In the adjacencies of the peripheral surface of the photosensitive drum 100, the image forming station, which has already been described, is disposed.

The image forming apparatus is structured so that as the toner supply container 1 is inserted into the hollow of the photosensitive drum 100, the lengthwise direction of the toner supply container 1 becomes roughly parallel to the lengthwise direction of the photosensitive drum 100.

The method (procedure) for properly positioning in the image forming apparatus (more specifically, in the hollow of photosensitive drum 100) is as follows: An operator is to open a cover, with which the apparatus is provided for toner container exchange, and then, insert (mount) the toner supply container 1 into the photosensitive drum 100.

(1) First, the toner supply container 1 is to be inserted into the internal space of the photosensitive drum 100 in the direction indicated by an arrow mark (FIG. 5(*a*)) so that the engaging portion 3*a* of the toner supply container 1 fits into the groove 100*a*located at the lengthwise end of the photosensitive drum 100.

(2) While the toner supply container 1 is inserted to the deepest end of the hollow of the photosensitive drum 100, the toner supply container 1 goes through the stage shown in FIG. 5(*b*), and comes into contact with a stopper plate located at the deepest end of the hollow of the photosensitive drum 100 to prevent the toner supply container 1 from being inserted further, ending the insertion of the toner supply container 1, with the toner supply container 1 being in the state shown in FIG. 5(*c*); the toner supply container 1 cannot be inserted beyond the position in which it is in the condition shown in FIG. 5(*c*).

As described above, at the end of the insertion of the toner supply container 1, the protrusions 2*a* of the snap-lock portion of the sealing member 2 fit into the holes 20*h*, one for one, locking the sealing member 2 to the coupler 20, ensuring that the sealing member 2 is secured to the coupler 20.

Also at the end of the insertion of the toner supply container 1, the gear portion 3 of the toner supply container 1 meshes with the driving gear 104 (FIG. 6) on the image forming apparatus main assembly side, making it possible for the toner supply container 1 to be driven. Incidentally, it is possible that the teeth of the gear portion 3 of the toner supply container 1 and the teeth of the driving gear 104 will be damaged by the impacts to which the teeth are subjected when the gear portion 3 and driving gear 104 come into contact with each other. Thus, the teeth on both sides are tapered at the tip to prevent them from being damaged by the impacts.

Also at the end of the insertion of the toner supply container 1, the engaging portion 3*a* of the toner supply container 1 fits into the groove 100*a* of the photosensitive drum 100, locking the toner supply container 1 and photosensitive drum 100 relative to each other in terms of the circumferential direction of the toner supply container 1 (photosensitive drum 100) so that the rotational driving force can be transmitted from the toner supply container 1 to the photosensitive drum 100.

(3) Next, the operator is to close the cover. The inward surface of this cover is provided with a toner supply container retaining portion, which is structured so that as the cover is closed, it comes into contact with the trailing end of the toner supply container 1, in terms of the toner supply container insertion direction, and remains in contact with the trailing end, preventing thereby the toner supply container 1 from moving upstream in terms of the toner supply container insertion direction.

(4) As the cover is closed, the coupler 20, which is in engagement with the sealing member 2, is slid by the cover in the direction to move away from the container proper 1A. As a result, the toner outlet 1*a* is unsealed, as shown in FIG. 11. That is, it is made possible for the toner in the toner supply container 1 to be discharged through the toner outlet 1*a*.

(5) After the unsealing of the toner supply container 1 (outlet 1*a*), the driving gear 104 is rotationally drive by a motor with which the image forming apparatus main assembly is provided. As a result, the toner is supplied (discharged) from the toner supply container 1 into the image forming apparatus (developing device).

Figure 7:
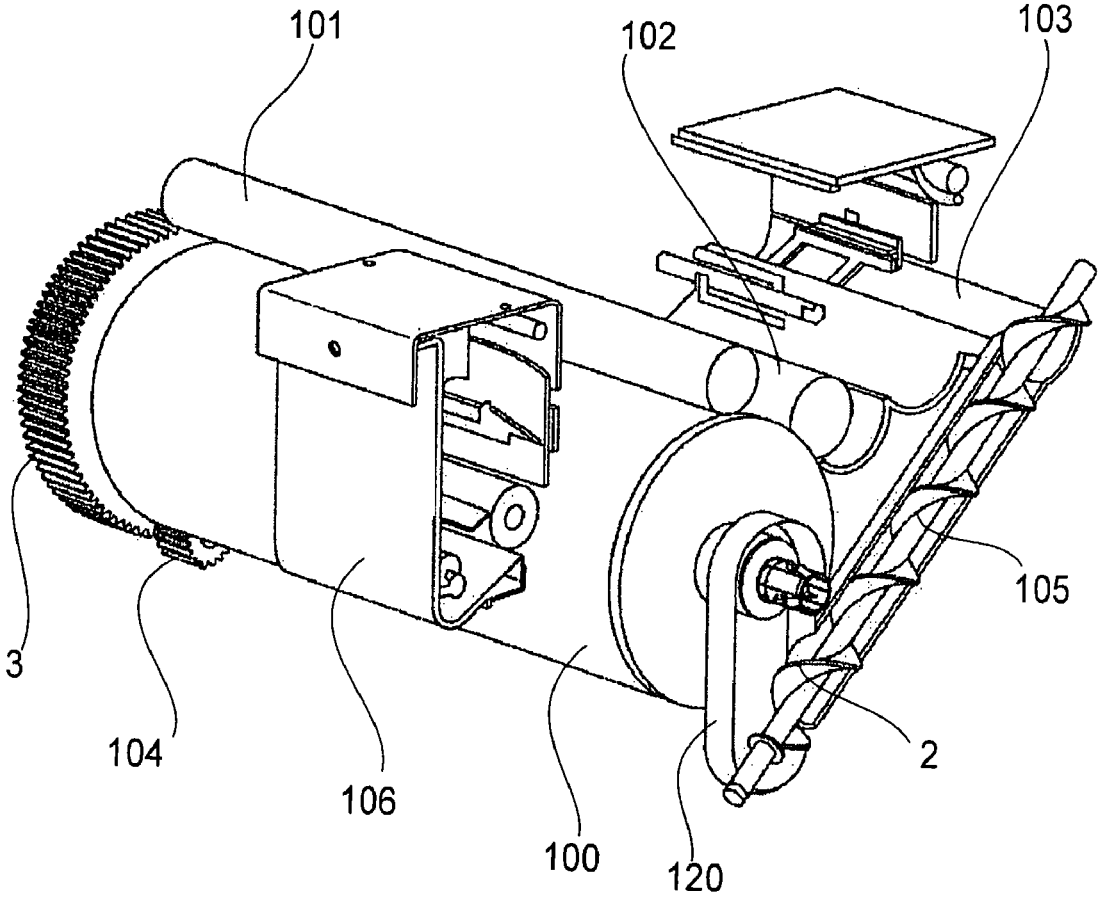
FIG. 7 is a partially cutaway perspective view of the toner supply container, photosensitive drum, and their adjacencies, showing their positional relationship after the completion of the toner supply container mounting operation.

Referring to FIG. 7, as the toner supply container 1 receives the rotational driving force from the driving gear 104 after the proper positioning of the toner supply container 1 in the apparatus main assembly, it discharges the toner through the toner outlet 1*a*. Then, the discharged toner accumulates in a temporary hopper 120 as a toner catching portion, and then, is conveyed from the temporary hopper 120 to the developing device 103 by a toner conveyance screw 105.

As described above, as the toner supply container 1 is inserted into the photosensitive drum 100 and properly set therein, not only does it engage with the driving gear 104, being thereby enabled to be driven by the gear 104, but also, it engages with the photosensitive drum 100, being thereby enabled to rotate the photosensitive drum 100. As a result, not only does it become possible for the rotational driving force, which the toner supply container 1 receives from the image forming apparatus (driving gear 104), to be used for rotating the toner supply container 1 to supply the image forming apparatus with toner, but also, it can be used to rotate the photosensitive drum 100 for image formation.

In this embodiment, the gear portion 3 of the toner supply container 1 doubles as the portion through which driving force is transmitted to the photosensitive drum 100. Therefore, each time the toner supply container 1 is replaced, the portion (gear portion 3) through which driving force is transmitted to the photosensitive drum 100 is also replaced with a brand-new one, preventing thereby the problem that the driving force transmission efficiency declines due to the excessive amount of frictional wear of the gear portion 3, which occurs as the cumulative length of usage of the gear portion 3 becomes excessive. Therefore, it is possible to keep stable the peripheral velocity of the photosensitive drum 100 of the image forming apparatus, at a preset value for a long period of time, making it thereby possible to enable the image forming apparatus to continuously yield high quality images for a long period of time.

Also in this embodiment, the toner supply container 1 is mounted in the photosensitive drum 100. This placement of the toner supply container 1 in the photosensitive drum 100 contributes to the reduction in the size of the image forming apparatus main assembly. Further, the toner supply container 1 is used as an intermediary for rotationally driving the photosensitive drum 100, integrating thereby the mechanism for driving the toner supply container 1 and that for driving the photosensitive drum 100 into a single driving mechanism, contributing to the simplification of the image forming apparatus main assembly. Further, unless the developer supply container 1 is mounted into the photosensitive drum 100, the photosensitive drum 100 cannot be rotationally driven (image forming operation cannot be carried out). Therefore, it does not occur that an image forming operation is started without having a developer supply container 1 set in the apparatus main assembly. Further, the hollow of the photosensitive drum 100 is utilized as the space into which the toner supply container 1 is mounted. Therefore, the amount of force necessary to rotationally drive the photosensitive drum 100 in this embodiment is greater than that necessary to rotationally drive a photosensitive drum in accordance with the prior art, contributing to the stableness of the peripheral velocity of the photosensitive drum 100.

(Toner Supply Container Replacement Operation)

Next, referring to FIG. 12, the operation for replacing the toner supply container will be described.

Figure 12:
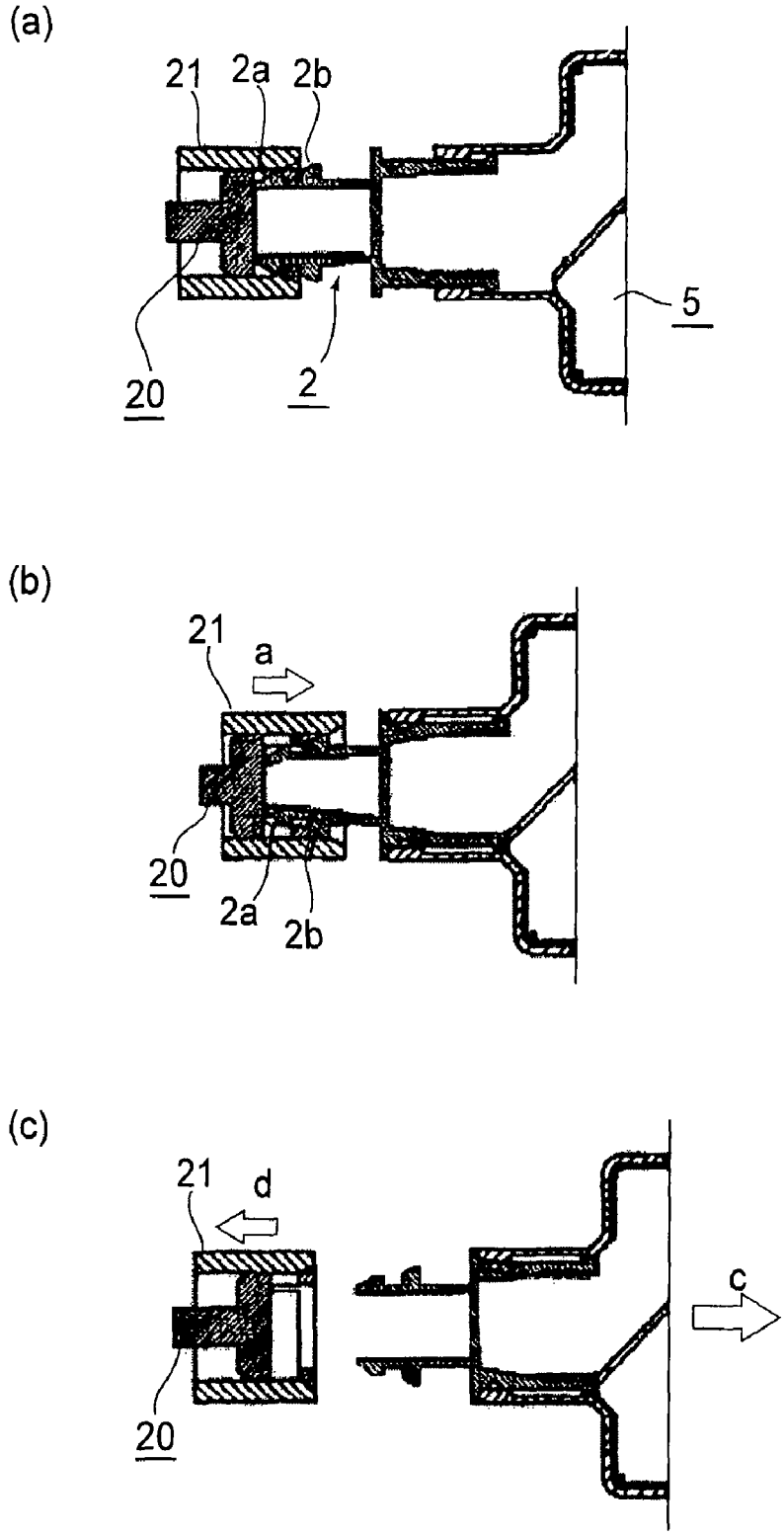
FIG. 12 is a schematic cross-sectional view of the toner outlet portion of the toner supply container, (a) before, (b) during, and (c) after the resealing of the toner supply container.

FIG. 12(*a*) shows the state of the toner outlet, in which the toner outlet is open, and therefore, the toner in the toner supply container can be discharged through the toner outlet.

As it is determined that the amount of the toner remaining in the toner supply container 1 is insufficient, the above-mentioned decoupler ring 21, with which the image forming apparatus main assembly is provided, is slid toward the toner supply container 1 (in the direction indicated by arrow mark a in the drawing)), causing thereby the snap-lock portion of the sealing member 2 to deform inward in terms of the radius direction of the sealing member 2 (FIG. 12(*b*)). As the snap-lock portion is deformed as described above, the deformation of the snap-lock portion causes the projections 2*a* to come out of the holes 20*h*, in which they overlap with the coupler 20, in terms of the direction in which the toner supply container 1 is to be removed. Thereafter, the decoupler ring 21 is slid further in the direction indicated by the arrow mark a, causing the flange portion and toner outlet sealing portion of the sealing member 2 toward the container proper 1A. As a result, the toner outlet sealing portion of the sealing member 2 is pushed back into the toner outlet 1*a*, resealing thereby the toner outlet 1*a*. At the end of the resealing of the toner supply container, the toner supply container remains retained by the toner supply container retaining portion of the above-mentioned cover for toner supply container replacement, being therefore prevented from moving upstream in terms of the toner supply container insertion direction.

Thereafter, the coupler 20 is slid, along with the decoupler ring 21, in the opposite direction (indicated by arrow mark d in drawing). As a result, the sealing member 2 is disengaged from the coupler 20 (FIG. 12(*c*)).

Once the sealing member 2 becomes disengaged from the member 20, the toner supply container 1 can be pulled out by the operator in the direction indicated by an arrow mark c in the drawing; it is possible to replace the toner supply container 1.

As described above, in this embodiment, the image forming apparatus is structured so that the toner supply container 1 can be easily removed from the photosensitive drum 100. That is, the toner supply container 1 is in the form of a cartridge (toner cartridge). Therefore, it is removable from the photosensitive drum 100 without removing the parts, such as smaller screws, for anchoring the toner supply container 1. Therefore, the toner supply container 1 can be replaced at a different time from when the photosensitive drum 100 is replaced. Thus, this embodiment contributes to the reduction of the operational cost of the image forming apparatus.

Further, unlike the toner supply container in accordance with the prior art, the toner supply container 1 in this embodiment rotates with the photosensitive drum 100. Therefore, the toner supply container 1 in this embodiment more effectively stirs the toner therein than a toner supply container in accordance with the prior art. Therefore, it can smoothly discharge even toner that is inferior in fluidity. Thus, it can substantially reduce the unusable amount of toner in the toner supply container, that is, the amount of toner in the toner supply container, which cannot be discharged.

Incidentally, in the above-described embodiment, the image forming apparatus was structured so that the rotational driving force is transmitted from the developer supply container side to the photosensitive drum side. This structural arrangement, however, is not mandatory. For example, the image forming apparatus may be structured so that the rotational driving force is transmitted from the photosensitive drum side to the developer supply container side (reverse direction from rotational driving force transmission direction in this embodiment 1). In such a case, the ratio in revolution between the photosensitive drum and developer supply container can be optionally set by changing the reduction ratio with the provision of intermediary gears or the like. This structural arrangement is beneficial when it is desired to control the amount by which developer is supplied. Further, the structure of the image forming apparatus may be such that the photosensitive drum 100 and developer supply container 1 are each provided with their own gear portion, which directly engages with the driving gear 104 to directly receive the rotational driving force. However, from the standpoint of the simplification of the driving mechanism, the unmodified version of the structural arrangement in the this embodiment is preferable.

Embodiment 2

Next, referring to FIGS. 8 and 9, the second embodiment of the present invention will be described.

Figure 8:
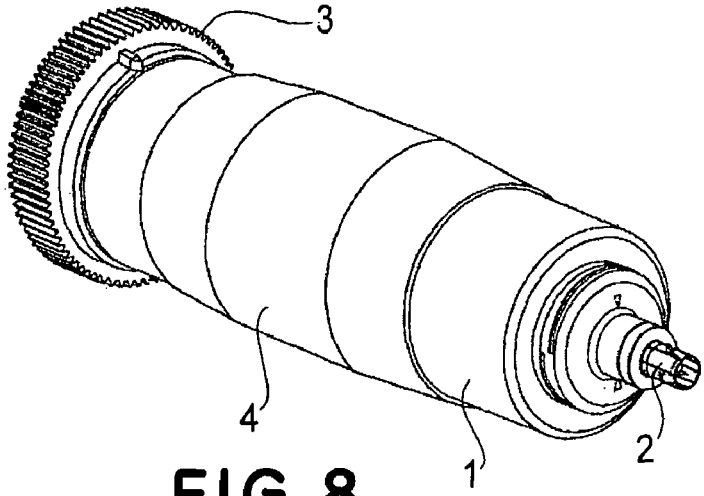
FIG. 8 is an external view of the toner supply container.
Figure 9:
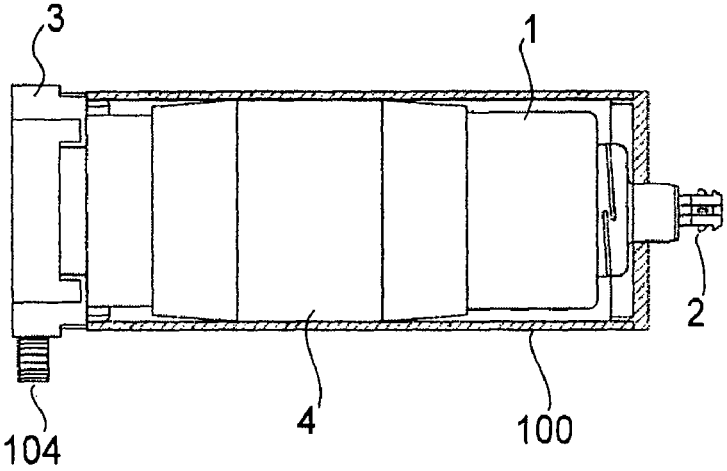
FIG. 9 is a schematic drawing of the toner supply container and photosensitive drum (sectional view), showing their positional relationship after the completion of the toner supply container mounting operation.

FIG. 8 is an external perspective view of the toner supply container in this embodiment, and FIG. 9 is a sectional view of the toner supply container in this embodiment.

This embodiment is different from the first embodiment described above, in that the toner supply container 1 in this embodiment is provided with a vibration absorbing member 4, which is fitted around the container proper 1A of the toner supply container 1. Otherwise, the second embodiment is the same as the first embodiment.

Figure 10:
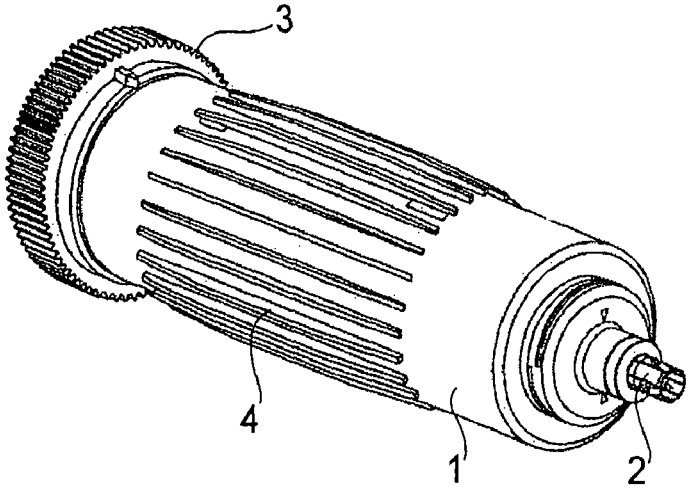
FIG. 10 is an external perspective view of a modified version of the toner supply container in the second embodiment of the present invention.

The vibration absorbing member 4 is an elastic member formed of elastomer or the like. It is inserted into the photosensitive drum 100 so that its peripheral surface is placed airtightly in contact with the internal surface of the photosensitive drum 100, as shown in FIG. 9, to absorb vibrations to prevent the photosensitive drum 100 from vibrating. The vibration absorbing member 4 may be formed of a material different from the material for the toner supply container 1, as shown in FIGS. 8 and 9. Obviously, however, in consideration of productivity, multiple vibration absorbing members 4 may be formed as integral parts of the toner supply container 1 as shown in FIG. 10.

As described above, in this embodiment, the toner supply container makes airtight contact with the internal surface of the photosensitive drum and rotates with the photosensitive drum. Therefore, not only can this embodiment reduce an image forming apparatus in size, but also, it can absorb vibrations to prevent the photosensitive drum from vibrating.

This embodiment is particularly effective when applied to an image forming apparatus which is structured as follows.

That is, as described above, in order to increase, in image formation speed, an image forming apparatus structured so that the photosensitive drum is charged by placing the charge roller in contact with the photosensitive drum, the photosensitive drum of the image forming apparatus must be increased in peripheral velocity. However, increasing the photosensitive drum in peripheral velocity possibly reduces the level of uniformity at which the peripheral surface of the photosensitive drum is charged. Thus, in order to prevent the decline in the level of uniformity at which the peripheral surface of the photosensitive drum is charged, it is possible to increase in frequency the AC voltage applied to the charge roller. However, if the AC voltage applied to the charge roller is increased in frequency to no less than roughly 200 Hz, it is possible that the image forming apparatus increases in the amount of noises attributable to the vibrations of the photosensitive drum and charge roller.

It has been discovered that the following mechanism is responsible for "noises attributable to the charging process", which become problematic when the contact charging method based on electrical discharge is employed.

That is, as oscillatory voltage is applied to a charge roller, electrostatic force occurs between the charge roller and a photosensitive drum. This electrostatic force causes the charge roller and photosensitive drum to attract each other. Further, when the amplitude of the oscillatory voltage applied to the charge roller is close to its largest or smallest value, the amount of this electrostatic force is substantial, causing the photosensitive drum and charge to elastically deform toward each other. On the other hand, when the amplitude of the oscillatory voltage is close to the middle between its largest value and zero, the electrostatic force is substantially smaller, allowing the resiliency of the charge roller to make the charge roller recover from the deformation. Therefore, the charge roller tends to move away from the photosensitive drum. Thus, as the oscillatory voltage is applied to the charge roller, the photosensitive drum and charge roller vibrate at twice the frequency of the applied oscillatory voltage.

Further, as the photosensitive drum and charge roller rotate, the peripheral surfaces of the photosensitive drum and charge roller rub against each other. Thus, when the amplitude of the oscillatory voltage is close to its largest or smallest value, that is, when the charge roller is attracted to the photosensitive drum, while elastically deforming, by the above-described substantial amount of electrostatic force, both the photosensitive drum and charge roller are slowed down in peripheral velocity by the above-mentioned friction between the two, whereas when the amplitude of the oscillatory voltage is close to the middle between the its largest value and zero, that is, when the above-mentioned electrostatic force is substantially smaller, the resiliency of the charge roller is allowed to cause the charge roller to recover from its elastic deformation, reducing thereby the amount of the contact pressure between the photosensitive drum and charge roller. Therefore, the friction between the photosensitive drum and charge roller, that is, the force which slows down the photosensitive drum and charge roller in peripheral velocity, is smaller. It is therefore possible that the peripheral surfaces of the photosensitive drum and charge roller will slip and stick relative to each other, generating thereby vibrations, as a finger does when it rubs the wet glass surface. The frequency of these vibrations is also twice the frequency of the applied oscillatory voltage.

The noises which occur when the photosensitive drum is charged by the charge roller are attributable to the above-described vibrations, and the frequency of the noises is basically twice the frequency of the applied alternating voltage. Therefore, when the frequency of the applied alternating voltage is 300 Hz, it is possible that noises which is 600 Hz in frequency will be heard. Further, high frequency noises which is several times in frequency the ordinary charging noises are sometimes heard. In rare cases, high frequency noises which are several times higher in frequency than the oscillatory voltage are heard.

Not only are the noises (vibrations), such as the above-described ones, which occur during the charging of the photosensitive drum, directly attributable to the vibrations which occur in the contact area between the photosensitive drum and charge roller, but also, to the vibrations of the devices, in the adjacencies of the photosensitive drum, which are caused by the vibrations transmitted to the devices from the photosensitive drum.

The above-described noises attributable to the charging of the photosensitive drum can be controlled by providing a toner supply container with a vibration absorbing member such as the one in this embodiment.

INDUSTRIAL APPLICABILITY

As described hereinabove, according to the present invention, it is possible to provide a downsized image forming apparatus since the space required for a developer supply container is minimized.

While the invention has been described with reference to the first and second preferred embodiments of the present invention, it is not confined to the details set forth, and this application is intended to cover such modifications or changes as may come within the purposes of the improvements or the scope of the following claims.

The invention claimed is:

1. A developer supply container detachably mountable to a hollow portion of a rotatable photosensitive member provided in an electrophotographic image forming apparatus including a driving member, said container comprising:

a rotatable container body having an inner space configured to contain a developer;

a feeding portion configured and positioned to feed the developer in said container body in an axial direction of said container body with a rotation of said container body to discharge the developer out of said container body;

a driving force receiving portion engageable with the driving member and configured and positioned to receive a rotational driving force for rotating said container body from the driving member; and a driving force transmitting portion, engageable with the photosensitive member and configured and positioned to transmit the rotational driving force received by said driving force receiving portion to said photosensitive member.

2. A container according to claim 1, wherein said driving force receiving portion includes a gear portion engageable with a gear portion of the driving member.

3. A container according to claim 1, wherein said driving force receiving portion is disposed adjacent an upstream end of said container body with respect to a developer feeding direction of said feeding portion.

4. A container according to claim 1, wherein a plurality of such driving force transmitting portions are provided discretely on a peripheral surface of said container body.

5. A container according to claim 4, wherein said driving force transmitting portions include projections engageable with respective recesses formed in the photosensitive member.

6. A container according to claim 1, wherein said driving force transmitting portion is closely contactable with an inner surface of the photosensitive member while permitting a mounting operation of said developer supply container thereinto.

7. A container according to claim 1, wherein said feeding portion includes a plate-like member extending in the axial direction of said container body, and said plate-like member is provided on a plurality of developer guiding portions inclined relative to the axial direction.

8. A container according to claim 1, wherein said container body further includes a vibration absorbing material configured and positioned to absorb a vibration of the photosensitive member.

9. A container according to claim 1, wherein said driving force transmitting portion is configured to contact an inner surface of the photosensitive member so that contact pressure is generated between said driving force receiving portion and the inner surface of the photosensitive member.

10. A container according to claim 9, wherein the generated contact pressure is configured so as to cause rotation of the photosensitive member by a rotation of said container body, while permitting a mounting operation of said developer supply container to the photosensitive member.

11. A developer supply system of an electrophotographic image forming apparatus comprising:

a photosensitive member having a hollow portion;

a driving member configured and positioned to apply a rotational driving force; and a developer supply container detachably mountable to said hollow portion of said photosensitive member, said developer supply container including:

a rotatable container body having an inner space configured to contain developer;

a feeding portion configured and positioned to feed the developer in said container body in an axial direction of said container body with a rotation of said container body to discharge the developer out of said container body;

a driving force receiving portion engageable with said driving member and configured and positioned to receive the rotational driving force for rotating said container body from said driving member; and a driving force transmitting portion engageable with said photosensitive member and configured and positioned to transmit the rotational driving force received by said driving force receiving portion to said photosensitive member.

* * * * *